US008122614B2

(12) United States Patent
Sussmann

(10) Patent No.: US 8,122,614 B2
(45) Date of Patent: Feb. 28, 2012

(54) SHOE, IN PARTICULAR SPORTS SHOE

(75) Inventor: Reinhold Sussmann, Scheinfeld (DE)

(73) Assignee: Puma SE, Herzogenaurach (DE)

( * ) Notice: Subject to any disclaimer, the term of this patent is extended or adjusted under 35 U.S.C. 154(b) by 765 days.

(21) Appl. No.: 12/281,882

(22) PCT Filed: Mar. 3, 2007

(86) PCT No.: PCT/EP2007/001836
§ 371 (c)(1),
(2), (4) Date: Sep. 5, 2008

(87) PCT Pub. No.: WO2007/101629
PCT Pub. Date: Sep. 13, 2007

(65) Prior Publication Data

US 2009/0071039 A1 Mar. 19, 2009

(30) Foreign Application Priority Data

Mar. 6, 2006 (DE) ..... 20 2006 003 491 U

(51) Int. Cl.
*A43B 23/07* (2006.01)
*A43B 23/08* (2006.01)

(52) U.S. Cl. ..... 36/10; 36/55; 36/69; 36/105

(58) Field of Classification Search ..... 36/10, 55, 36/69, 105, 115, 3 A
See application file for complete search history.

(56) References Cited

U.S. PATENT DOCUMENTS

| | | | | |
|---|---|---|---|---|
| 3,810,318 | A * | 5/1974 | Epstein | 36/105 |
| 5,397,141 | A * | 3/1995 | Hoshizaki et al. | 280/11.3 |
| 5,878,513 | A * | 3/1999 | Annovi et al. | 36/115 |
| 6,023,859 | A | 2/2000 | Burke et al. | |
| 6,226,898 | B1 | 5/2001 | Trimble et al. | |
| 6,457,265 | B1 * | 10/2002 | Lepage et al. | 36/117.1 |
| 6,993,859 | B2 * | 2/2006 | Martin et al. | 36/50.5 |
| 7,377,058 | B2 * | 5/2008 | Elkington et al. | 36/117.6 |
| 7,578,076 | B2 * | 8/2009 | Pawlus et al. | 36/100 |
| 7,730,636 | B2 * | 6/2010 | Auger et al. | 36/67 A |
| 7,954,259 | B2 * | 6/2011 | Antonelli et al. | 36/69 |
| 2006/0010718 | A1 | 1/2006 | Auger et al. | |

FOREIGN PATENT DOCUMENTS

| | | |
|---|---|---|
| DE | 28 52 867 | 6/1979 |
| EP | 0 841 017 | 5/1998 |
| EP | 0 970 629 A | 1/2000 |
| EP | 1048233 | 11/2000 |
| EP | 1402796 | 3/2004 |
| WO | 96/19127 | 6/1996 |
| WO | 2004/103105 | 12/2004 |

* cited by examiner

*Primary Examiner* — Ted Kavanaugh

(74) *Attorney, Agent, or Firm* — Lucas & Mercanti, LLP

(57) ABSTRACT

The invention relates to a shoe, in particular a sports shoe, with a shoe upper part and an outsole joined to the latter, and also with a heel shell, which at least partially encloses the heel of the wearer of the shoe. To allow the shoe to be adapted to individual needs in a simple and low-cost way, the invention provides that the heel shell is interchangeably arranged in the shoe upper part, wherein it has in a surface region at least one projection or a recess, which interacts with a recess or a projection in the shoe upper part to fix the heel shell in the shoe upper part with a form fit, wherein the heel shell is joined to an insert sole and wherein the heel shell and the insert sole are formed as one piece.

8 Claims, 4 Drawing Sheets

SHOE, IN PARTICULAR SPORTS SHOE

Figure 1:
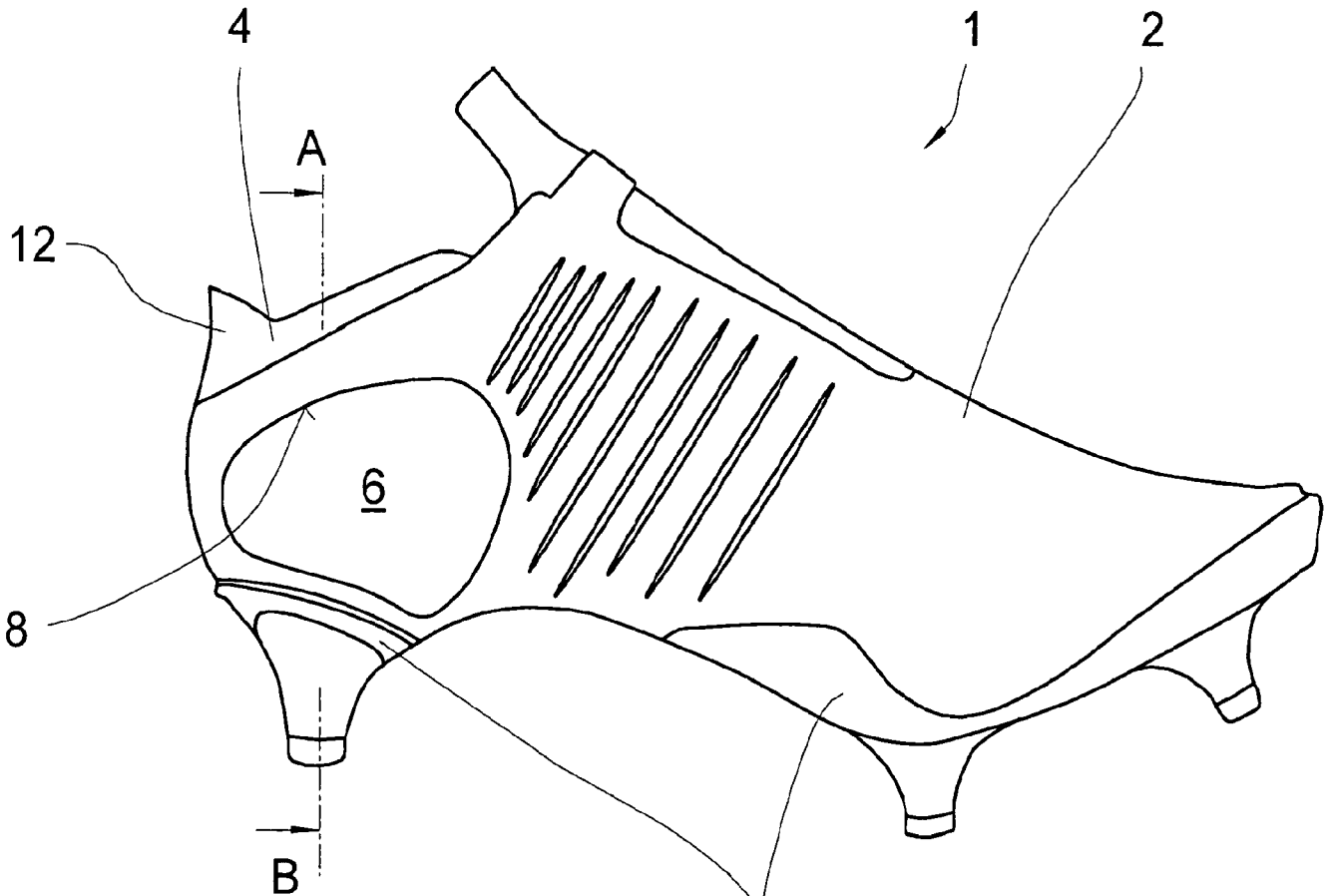

This application is a 371 of PCT/EP2007/001836 filed Mar.3, 2007, which claims the priority of DE 20 2006 003 491.9 filed Mar. 6, 2006, both of which are hereby incorporated by reference.

The invention relates to a shoe, in particular a sports shoe, having a shoe upper and an outsole connected thereto and having a heel shell, which at least partially encloses the heel of the person wearing the shoe.

Shoes, in particular sports shoes, of this type are known in general. In order for the wearer's foot to be gripped securely in the shoe, a heel shell is usually provided, and this encloses and accommodates the heel of the wearer's foot in three dimensions. The heel shell is usually fixed in the shoe, in particular adhesively bonded therein.

As the shoe is used, rubbing between the wearer's foot and the heel shell results in wear, in which case the service life of the shoe may be limited.

It is also disadvantageous that it is not possible, at least in a cost-effective manner, for the shoe, and in particular the heel shell, to be configured in accordance with individual requirements. With the exception of the special case of a custom-made shoe, the person wearing the shoe is dependent on a commercially available design of the heel shell. This is disadvantageous, in particular, when, in the case of inserts being used, the commercially available heel shell is not particularly favorable and it is desirable to elevate the guiding shaft of the heel shell.

It is further disadvantageous that it is not possible, or it is only possible with high outlay, to adapt the shoe, and in particular the heel shell, to particular requirements of the person wearing the shoe, in particular as far as the breathability or the stability of the heel shell is concerned. In many cases, the wearer has special requirements relating to the stiffness or softness of the heel shell.

It is known from DE 10 2004 014 807 B3 to provide, for ski boots, an inner boot which is arranged in an interchangeable manner in an outer boot shell. The inner boot here has protrusions which are directed outwards in different regions and engage in recesses of the ski boot. However, the principle which is disclosed in this prior-art document is not structurally suitable for, for example, sports shoes, where there is not the same amount of installation space available as in the case of a ski boot.

The object of the invention is to develop a shoe, in particular a sports shoe, of the type mentioned in the introduction so as to overcome the above-mentioned disadvantages. It should therefore be possible, in particular in a straightforward and cost-effective manner, to adapt the shoe to individual requirements. It should also be possible, in the case of wear, to provide a solution which allows continued use of the shoe. Much importance is placed on the functionality of the shoe not being restricted in any way, and this is extremely important in particular for use in sports, especially in competitive sports.

The way in which the invention achieves this object is characterized in that the heel shell is arranged in an interchangeable manner in the shoe upper, wherein in a surface region it has at least one protrusion or a recess, which interacts with a recess or a protrusion in the shoe upper for securing the heel shell in a form-fitting manner in the shoe upper, wherein the heel shell is connected to an insole, and that the heel shell and the insole are formed in one piece.

Although it is also possible for the heel shell to have a recess in which a protrusion of the shoe upper engages, it is preferably provided that the protrusion is arranged on the heel shell and engages in a recess in the shoe upper. Furthermore, the at least one protrusion or the at least one recess of the, or in the, heel shell advantageously has a shape adapted to the shape of the recess or of the protrusion in the shoe upper. A further development provides that two protrusions or recesses are arranged in the side region of the heel shell. In this case, it may be provided that the two protrusions or recesses are arranged in the region of the ankle of the person wearing the shoe.

The heel shell can be secured in the shoe upper to good effect, albeit with low levels of pressure being applied, if each protrusion or each recess, as seen in lateral projection of the shoe, has a surface area which is at least 25%, preferably at least 33%, of the surface area of the heel shell, as seen in lateral projection.

The at least one protrusion or the at least one recess of the, or in the, heel shell may have an elongate or essentially oval shape, and this prevents rotation of the heel shell relative to the shoe upper about a horizontal axis in a direction transverse to the longitudinal direction of the shoe.

It is particularly preferably provided that the at least one protrusion or the at least one recess is arranged only in the region of the heel shell, in particular in the side regions thereof.

A development of the invention provides that the heel shell and possibly the insole has at least one further protrusion which extends in the direction of the ground through a recess in the shoe upper.

The shoe upper and/or the outsole and/or the heel shell advantageously consist of plastic, in particular of thermoplastic material. It is conceivable here to use, in particular, polyethylene, polypropylene, polybutane, polyamide, polyurethane or a mixture of at least two of these plastics.

The shoe upper may be described, within the context of the invention, as a chassis which is provided with the heel shell preferably with the insole connected thereto. The shoe upper may consist both of hard material and of soft material. It is particularly preferably produced by injection molding, or may at least be preformed. Use is made here both of plastics and of classic shoe materials (leather, textiles, etc.).

The proposed configuration easily makes it possible for the heel shell, in the case of wear, to be changed over, in which case the shoe can still be used. This is highly advantageous, in particular, in the case of high-price sports shoes.

Furthermore, the shoe can be adapted individually, i.e. it is possible to insert into the shoe upper a heel shell which is geared to specific requirements. Only the heel shell has to be adapted for this purpose; modifications to the shoe are not necessary. It is therefore possible for a shoe, in particular sports shoe, which is adapted to the wearer's requirements to be realized very much more cost-effectively than has been the case up until now.

This applies especially when the person wearing the shoe requires inserts. In this case, the heel shell can be designed optimally for the inserts without the (upper part of the) shoe itself having to be modified. Specifically, the height of the heel shell can be selected optimally in dependence on the inserts used.

The fit of the shoe can thus be configured ideally for the wearer's foot.

A further advantage is that the solution according to the invention allows materials to be selected freely, in which case it is possible to use any desired materials. The material of the shoe upper and that of the heel shell are adapted to individual requirements, for example so as to achieve the desired stability or breathability of the shoe.

Figure 2:
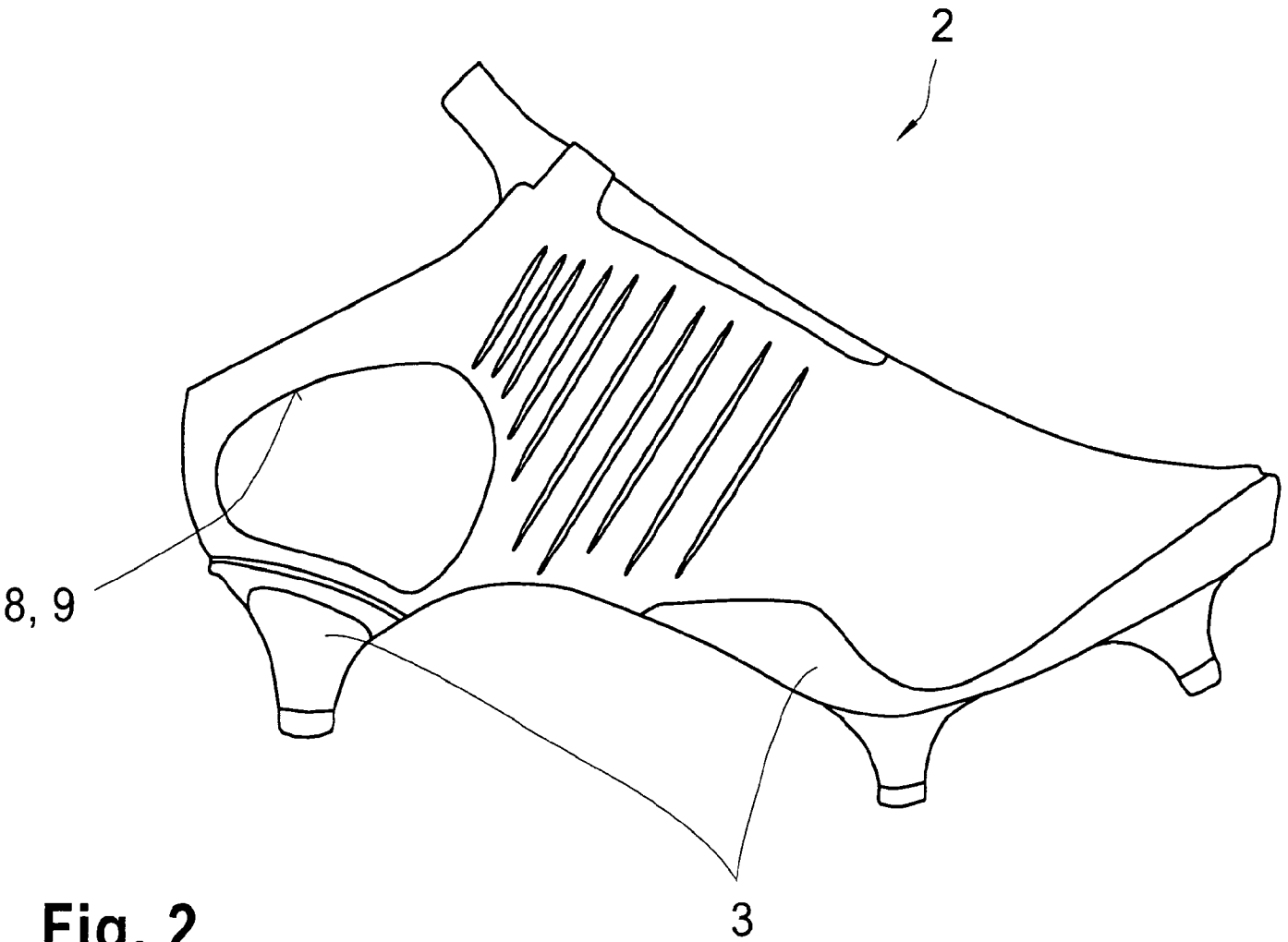
Figure 3:
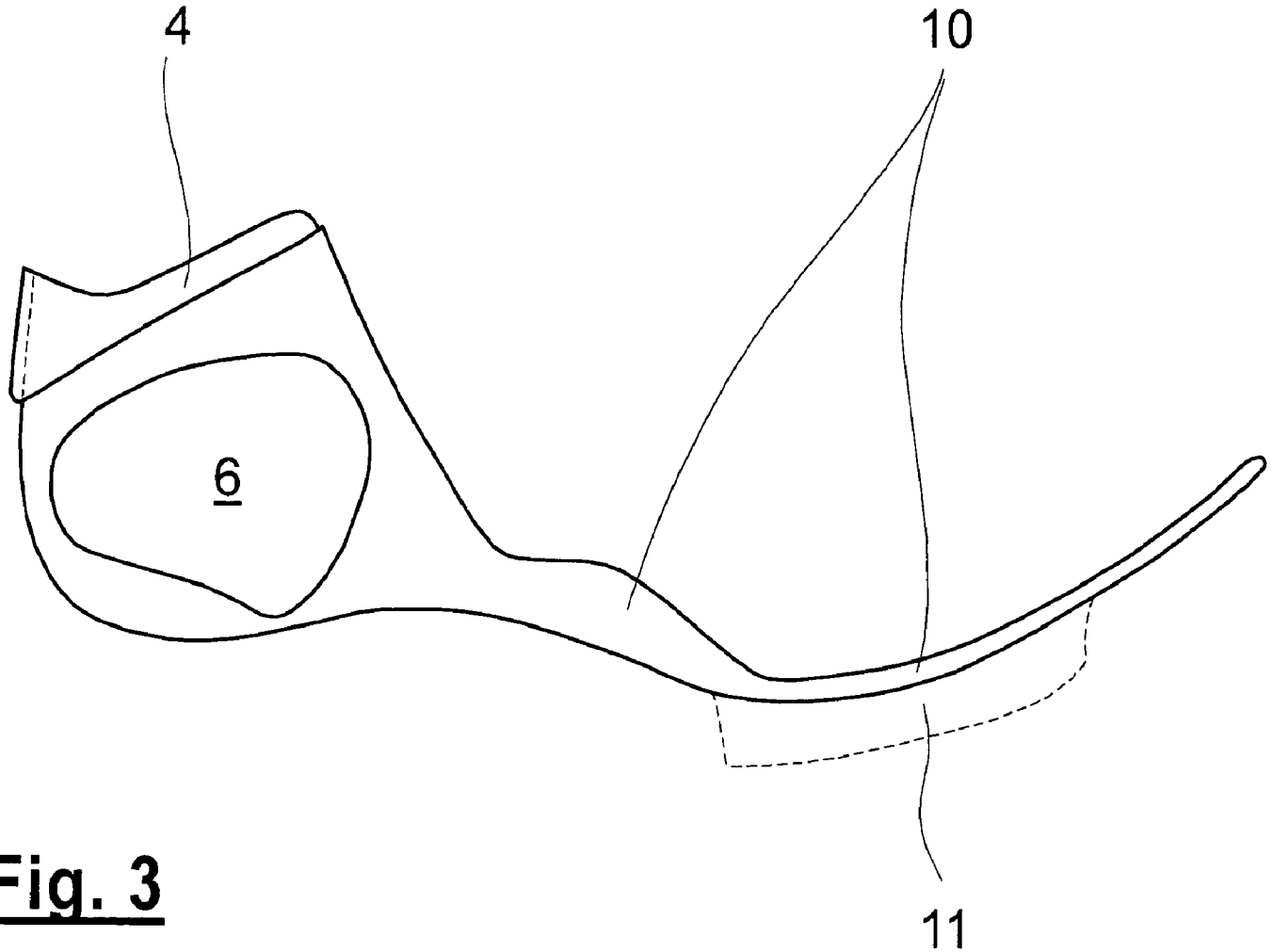
Figure 4:
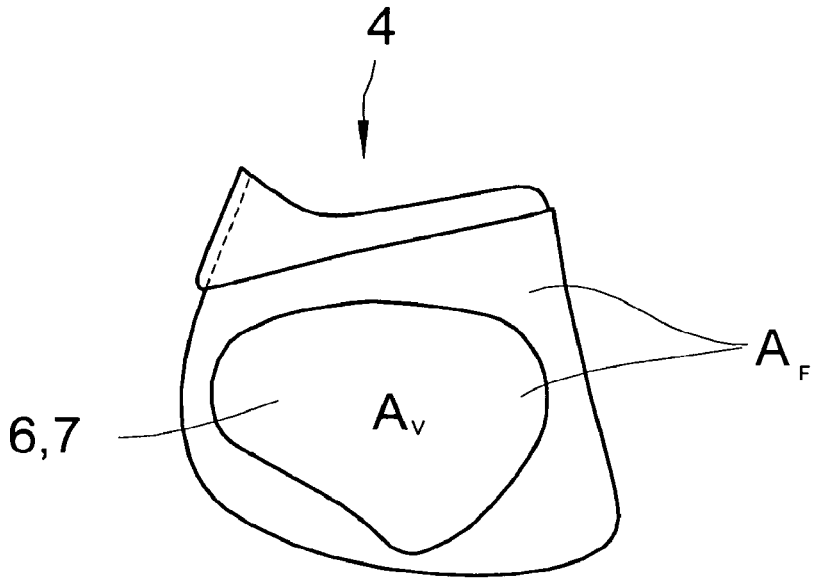
Figure 5:
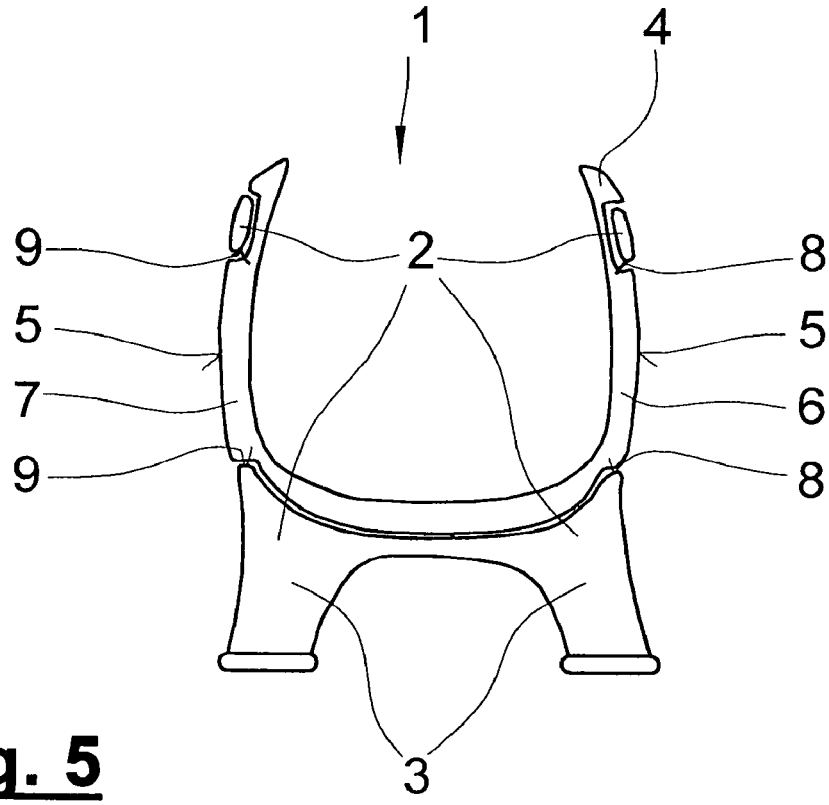

Exemplary embodiments of the invention are illustrated in the drawing, in which:

FIG. 1 shows a sports shoe, as seen from the side,

FIG. 2 shows the shoe upper together with the outsole of the sports shoe according to FIG. 1, without any heel shell, as seen from the side, FIG. 3 shows the heel shell which is to be inserted into the shoe upper according to FIG. 2 and has an insole connected integrally to it, as seen from the side, FIG. 4 shows the heel shell which is to be inserted into the shoe upper according to FIG. 2 and does not have any insole, as seen from the side, and FIG. 5 shows the section A-B according to FIG. 1.

FIG. 1 illustrates a sports shoe 1 from the side, this sports shoe having, in a known manner, an shoe upper 2, which is connected to an outsole 3.

A heel shell 4 (inner shell) is inserted in an interchangeable manner into the shoe upper 2. In the inserted state, the heel shell 4 extends beyond the top side of the shoe upper 2, i.e. it has a corresponding shaft 12, of which the extent is selected in accordance with the requirements of the person wearing the shoe 1 so as to ensure optimum guidance and grip of the foot.

FIGS. 2 and 3 illustrate, first of all, the shoe upper 2 without a heel shell 4 inserted and, secondly, the heel shell 4 itself. In order that, in the state in which it has been inserted into the shoe upper 2, the heel shell 4 is seated firmly and securely there, the shoe upper 2 has recesses 8 and 9, which are arranged on both sides in the ankle region of the shoe upper 2. In accordance with the shape of these recesses 8, 9 or cut-outs, the heel shell 4 has in the surface region 5 (cf. FIG. 5), in its two side regions, protrusions 6, 7 which project from the basic contour of the heel shell 4 and of which the shape corresponds to that of the recesses 8, 9.

It can be seen in FIG. 5 that the protrusions 6, 7 engage in the recesses 8, 9 to give a largely uninterrupted contour, i.e. in an essentially smooth line, on the outside of the shoe 1. It is therefore not only the case that the protrusions 6, 7 are configured such that—as can be seen in FIG. 1—the surface area of the protrusion 6, 7 corresponds to that of the recess 8, 9; in addition, it is also the case that the height of the protrusions 6, 7 is selected so as to give a largely flush surface of the shoe 1 in the side region.

It can be seen in FIG. 3 that the heel shell 4 is connected to an insole 10. In the present case, the heel shell 4 and the insole 10 are in one piece. This has the advantage that it is also possible if required, by virtue of the heel shell 4 being changed over, for the insole to be changed and/or adapted to individual requirements.

Dashed lines are used in FIG. 3 to indicate that it is possible to arrange, on the underside of the insole 10, a further protrusion 11 in the form of an outsole part, which is, for example, injection molded on the insole. A recess—not illustrated—may be arranged in the floor region of the shoe upper 2 and/or of the outsole 3, the protrusion 11 passing through this recess and thus forming part of the outsole. It is possible for the protrusion 1 to be designed to fit the corresponding recess precisely and to have, if appropriate, sealing means in order to prevent moisture from entering into the shoe from beneath.

FIG. 4 illustrates the side view of the heel shell 4 in an alternative configuration of the invention, namely without an insole 10 arranged on it. Comparing FIGS. 3 and 4 shows the extent of the heel shell 4 and where the insole begins.

The size selected for the surface area of the protrusions 6, 7 and of the corresponding recesses 8, 9 is important. In order that, on the one hand, it is ensured that the heel shell 4 is gripped securely in the shoe upper 2, this also providing sufficient resistance to torsional movement of the heel shell 4 about a horizontal axis in a direction transverse to the longitudinal direction of the shoe, and, on the other hand, the ankle region of the person wearing the shoe 1 is not subjected to any lateral pressure, provision is made for the following:

The protrusion 6, 7 and the recess 8, 9 are non-round, i.e., in the present case, they are elongate or oval. Furthermore, the lateral projection surface area $A_V$ of the protrusion 6, 7 is at least 25% of the lateral projection surface area $A_F$ of the heel shell 4, as can be gathered from FIG. 4. The surface area $A_V$ is preferably at least 33% of the surface area $A_F$. It can be seen that the shape of the protrusions 6, 7 and of the recesses 8, 9 is selected such that a kind of point or nose is provided at a circumferential location of the protrusions/recesses (namely in the lowermost region of the protrusions 6,7), and this point or nose prevents the torsional movement mentioned above.

It can be seen, for example in FIG. 1, that the protrusions 6, 7 and recesses 8, 9 extend, as seen in the longitudinal direction of the shoe 1, preferably over the entire ankle region.

LIST OF DESIGNATIONS

1 Shoe (sports shoe)
2 Shoe upper
3 Outsole
4 Heel shell
5 Surface region
6 Protrusion
7 Protrusion
8 Recess
9 Recess
10 Insole
11 Protrusion
12 Shaft
$A_V$ Lateral projection surface area of the protrusion/of the recess
$A_F$ Lateral projection surface area of the heel shell

The invention claimed is:

1. A shoe comprising a shoe upper and an outsole connected to the shoe upper;

two recesses in the shoe upper, one of each of the two recesses positioned only on each side of the shoe upper in an ankle region of the shoe upper, each of the two recesses extending through the side of the shoe upper;

a heel shell which at least partially encloses a heel of a person, the heel shell interchangeable in the shoe upper, the heel shell extending along each side of the shoe upper in the ankle region;

an insole extending from the heel shell and fitting within the shoe upper, the insole has a protrusion extending towards the ground, the heel shell and the insole are formed in one piece;

two horizontal protrusions on the heel shell, one of each of the two horizontal protrusions positioned only on each side of the heel shell opposite the side of the upper shoe in the ankle region; and one of each of the two horizontal protrusions of the heel shell fitting in one of each of the two recesses in the shoe upper to secure the heel shell in a form fitting manner in the shoe upper.

2. The shoe of claim 1, wherein each of the two horizontal protrusions of the heel shell have a shape adapted to a shape of the each of the two recesses in the shoe upper.

3. The shoe of claim 1, wherein each of the two horizontal protrusions of the heel shell covers at least 25% of a side surface area of the side of the heel shell.

4. The shoe of claim 3, wherein each of the two horizontal protrusions of the heel shell cover at least 33% of the side surface area of the side of the heel shell.

5. The shoe of claim 1, wherein each of the two horizontal protrusions has an oval shape.

6. The shoe of claim 1, wherein each of the two horizontal protrusions has an elongated shape.

7. The shoe of claim 1, wherein the shoe upper, the outsole, the heel shell and the insole are made of a thermoplastic material.

8. The shoe of claim 7, wherein the thermoplastic material is polyethylene, polypropylene, polybutane, polyamide, polyurethane or a mixture of two or more of these.

* * * * *